US006416153B1

(12) United States Patent
Pan et al.

(10) Patent No.: US 6,416,153 B1
(45) Date of Patent: Jul. 9, 2002

(54) AUTOMATIC TOP-OF-FORM CALIBRATION OF A PRINTER

(75) Inventors: Wei Ming Pan; Ching Yong Chua; Kok Sam Yip, all of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/703,454

(22) Filed: Oct. 31, 2000

(30) Foreign Application Priority Data

Jan. 5, 2000 (SG) ..... 200000005-9

(51) Int. Cl.[7] ..... B41J 2/01
(52) U.S. Cl. ..... 347/19
(58) Field of Search ..... 347/14, 37, 41, 347/16, 104; 400/74

(56) References Cited

U.S. PATENT DOCUMENTS 5,677,716 A * 10/1997 Cleveland ..... 347/37
5,825,378 A * 10/1998 Beauchamp ..... 347/19

* cited by examiner

*Primary Examiner*—Craig A. Hallacher

(57) ABSTRACT

For top-of-form calibration of a printer in which a printing medium is fed into a printing position, a predefined pattern is printed so that a print is generated on the print medium. After the print is detected, a feature of the print is determined. The feature is indicative of the printing position. By using a correction factor, which is determined from the feature, the calibration is performed.

14 Claims, 5 Drawing Sheets

AUTOMATIC TOP-OF-FORM CALIBRATION OF A PRINTER

BACKGROUND OF THE INVENTION

This invention relates to a method, a device, a computer readable medium, a computer program element for top-of-form calibration of a printer, as well as a printer with the device.

Inkjet printer technology is increasingly making in-roads to the office and workgroup environment.

One problem that arises with a currently available printer is that due to mechanical tolerances and irregularity in paper stack up, there is a varying top-of-form position ("printing position"), which is the position of a medium when the top edge of the medium is directly under the last nozzle of the printer's print head. This is the zero vertical axis (y-axis) position to which in the following all print positions make reference.

The word "print medium" is herein used as a representative of any medium such as paper or transparency upon which, for example, ink or toner may be printed by a printer.

A printer may as well be a printer using inkjet technology, laserjet® technology or any other printing technology for which it is important to have a calibration of a top-of-form position of the respective medium.

As yet there is no cheap and easy technology known which gives a sufficiently good automatic top-of-form calibration for a printer.

SUMMARY OF THE INVENTION

It is thus an object of the present invention to provide an easy, cheap and robust way for automatic top-of-form calibration of a printer.

The object is achieved by a method, a device, a computer readable medium and a computer program element for top-of-form calibration of a printer, as well as a printer with the device.

In the inventive method for top-of-form calibration of a printer, a printing medium is fed into a printing position. A predefined pattern is printed, thereby generating a print on the print medium. Subsequently, the print is detected from the print medium. After the print has been detected, a feature of the print being indicative of said printing position, such as the colour and/or the positional value of the print is determined from the detected print in dependency on a distinct positional characteristic of the print medium. Based on the determined feature of the print, a correction factor for correcting said printing position is determined. If for example, the positional value of the print is utilized as said feature of the print, it is compared with a predetermined reference positional value and, if present, a deviation of the determined positional value from the reference positional value is determined. The correction factor is then determined from said deviation. Eventually, the top-of-form calibration of the printer is processed by adjusting said printing position on the basis of the determined correction factor.

According to another aspect of the invention, a device for top-of-form calibration of a printer comprises means for performing the steps described above.

According to further aspects of the invention, a computer readable medium with a program recorded thereon and a computer program are provided, where the program makes the computer execute a procedure comprising the steps mentioned above.

The invention provides an easy, cheap and robust way for automatic top-of-form calibration of a printer.

Thereby the variability of the top-of-form position of the media in a printer can be reduced.

In this context, the predefined pattern is generated, for example, by a print head of an inkjet et printer.

Furthermore, the word "print" is used for what is actually printed on the print medium after the predefined pattern has been generated.

The predefined pattern can comprise components of any form, for example, circles, rectangles, etc. and any combination thereof. In case of a colour printer the pattern may comprise components of different colours. It only has to be possible to determine a feature of the print such like the form, colour and/or the positional value of the print at a distinct position of the print medium. And said feature is indicative of the printing position, into which the medium has originally been fed. Once this feature of the print is determined, the calibration of this original printing position, i.e., the top-of-form position, can be carried out.

The invention may be implemented in a programmable computer device as well as with a special electronic circuit.

DESCRIPTION OF THE PREFERRED EMBODIMENTS

Preferred embodiment s of this invention and modifications thereof will now be described with reference to the accompanying drawings.

Figure 2:
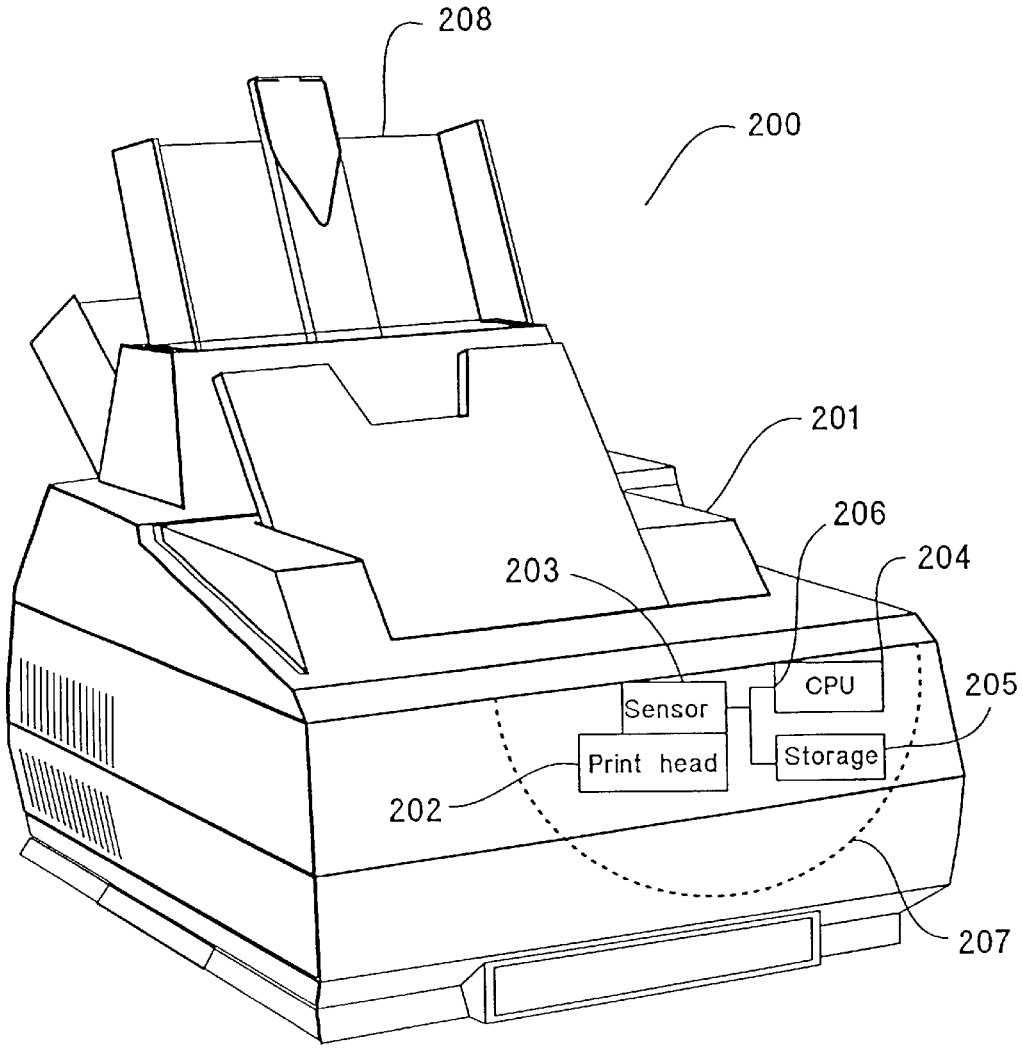
FIG. 2 is a diagram of a printer with a sensor and a device arranged in such a way that the method according to the preferred embodiment can be executed.

In FIG. 2, a printer 200 using inkjet technology is shown.

The printer 200 comprises a carriage 201, a print head 202, a sensor 203, a central processing unit (CPU) 204, a storage device 205, and an input tray 208.

The sensor 203, the CPU 204 and the storage device 205 are connected via a bus 206.

Dotted line 207 is intended to represent the fact that the print head 202, the sensor 203, the CPU 204 and the storage device 205 are arranged within the printer's carriage 201.

The storage device 205 is a non-volatile storage.

The sensor 203 comprises a light emitting diode (LED) for shining light onto the print medium (in this embodiment a sheet of paper) and an optical detector for detecting the light reflected from the medium.

Figure 7:
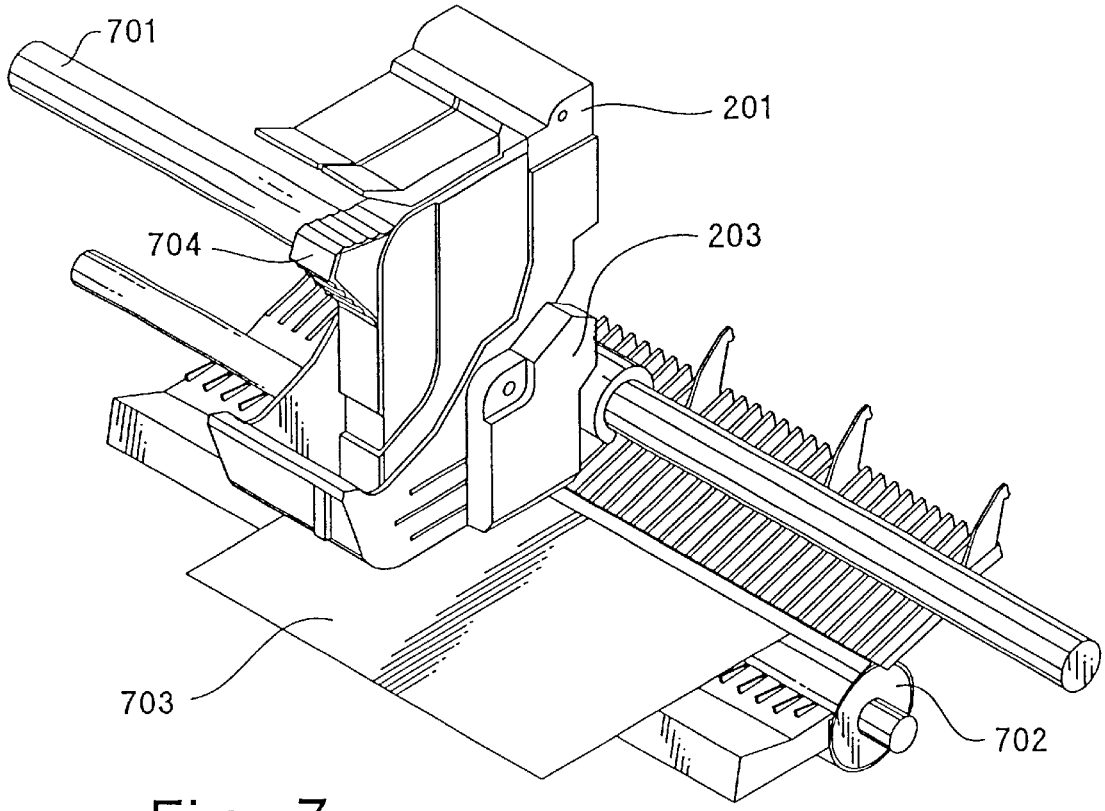
FIG. 7 shows the position of the sensor on the carriage print path.

In FIG. 7, the position of the sensor 203 on the carriage 201 is shown. Furthermore, a carriage shaft 701, a drive roller 702, the medium paper 703, and an ink cartridge 704 are shown.

Figure 8:
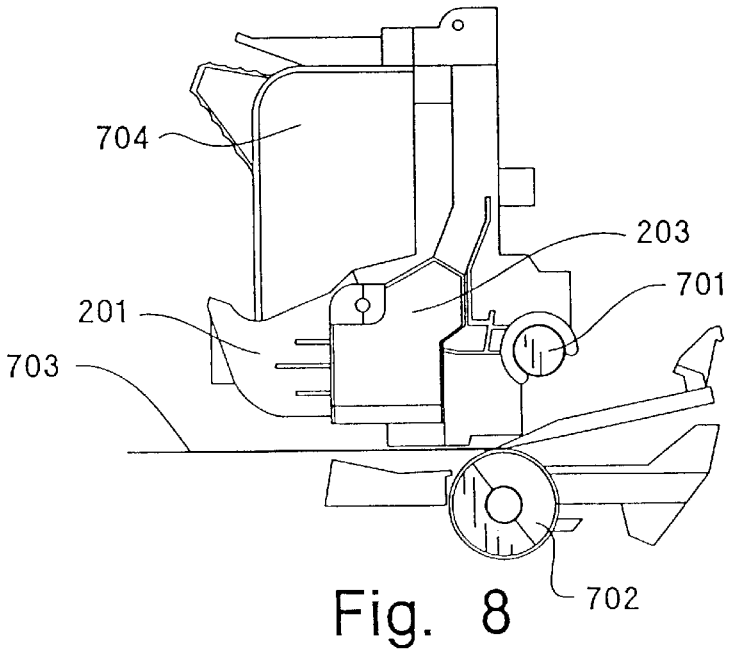
FIG. 8 shows a close-up of the sensor on the carriage.

A close-up of the sensor 203 is shown in FIG. 8. Same numbers are used to represent the same objects.

The sensor 203 is attached to the carriage 201 of the printer 200 to provide a closed-loop mechanism for monitoring the physical conditions within the print zone.

Figure 1:
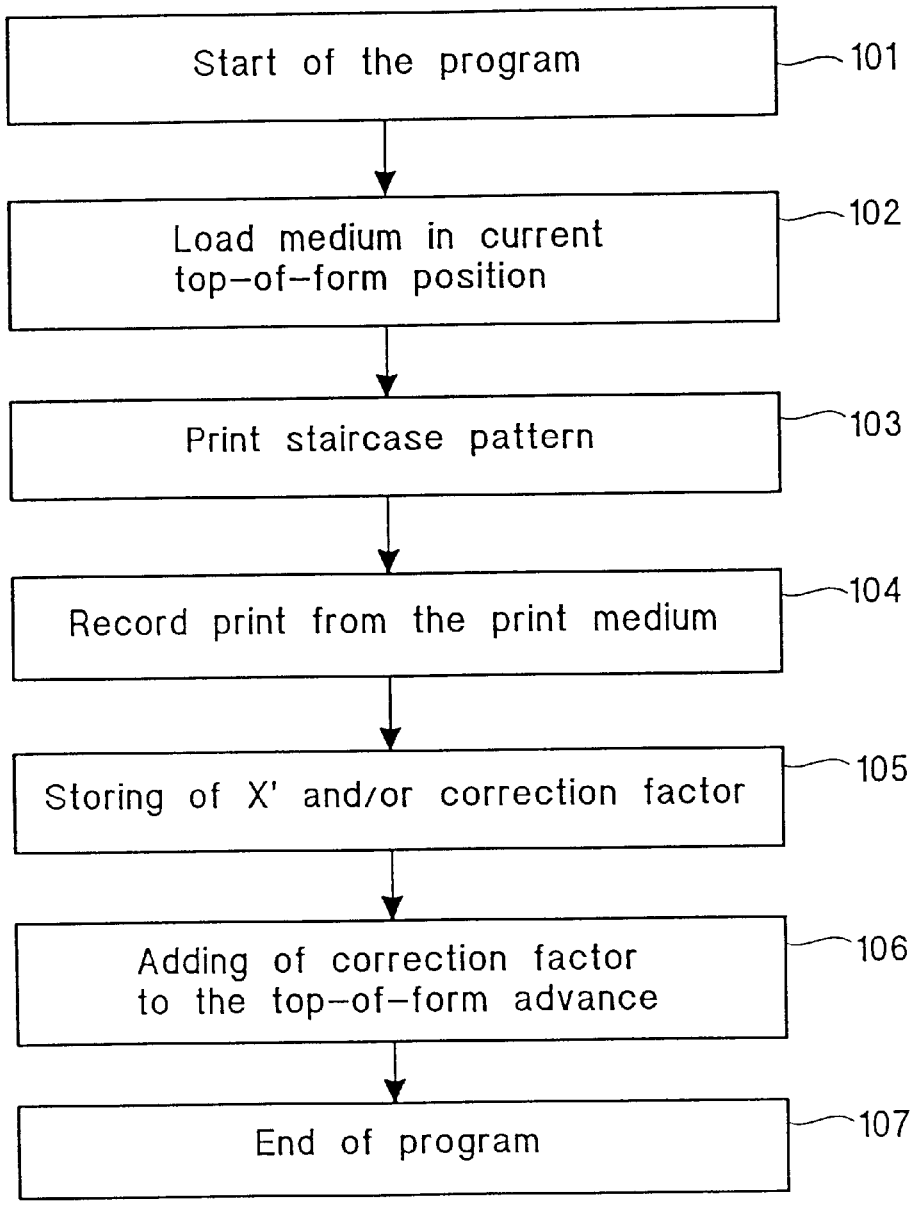
FIG. 1 is a flowchart of the method for top-of-form calibration of a printer according to the preferred embodiment.

With reference to FIG. 1, the method for automatic top-of-form calibration will now be described in detail.

In a first step 101, the computer program stored in the storage device 205 of the printer 200 is started.

In a second step 102, a piece of the print medium in the input tray 208 of the printer 200 is loaded into the original top-of-form position, in the following referred to as printing position.

At this y-axis position, in a third step 103, a staircase pattern 300 is printed by the printer 200, thereby generating a print on the paper placed in the printing position in the printer 200. In this context, it should be mentioned that the calibration may also comprise an x-axis component.

The staircase pattern 300 for the automatic top-of-form calibration according to this preferred embodiment of the invention comprises nine solid yellow bar-steps 302, 303, 304, 305, 306, 307, 308, 309, 310 and one vertical solid yellow reference bar 301 to the left of the plot. The vertical solid yellow reference bar 301 begins at the top of the first bar-step 302 and extends to the bottom of the last bar-step 310 (cf. FIG. 3). The printed pattern can be designed to include some wordings, like indications regarding correction factors, such as "0", "0.5", "−0.5" etc, as shown in FIGS. 3 to 6. In such a case, however, the bar steps 302, 303, 304, 305, 306, 307, 308, 309, and 310 should precede these wordings in the horizontal direction (x-axis).

The height of each solid bar-step 302, 303, 304, 305, 306, 307, 308, 309, 310 is 0.508 mm, which can be printed with 12 nozzles of the print head 202 using a pen in which each nozzle has a size of 1/600 inch. Thus, the height of the reference bar 301 is 4.572 mm. Furthermore, the width of the reference bar 301 is chosen to be 0.508 mm as well. The height of each solid bar-step 302, 303, 304, 305, 306, 307, 308, 309, 310 determines the precision or a correction factor of the calibration. Each bar-step 302, 303, 304, 305, 306, 307, 308, 309, 310 is placed immediately below the preceding bar-step vertically but horizontally offset by a fixed-internal distance from the left reference bar 301. For this purpose, the amount is arbitrarily chosen to fit the nine bar-steps 302, 303, 304, 305, 306, 307, 308, 309, 310 and the reference bar 301 onto an A-size medium.

As described above, the top of the reference bar 301 is horizontally aligned with the top of the first solid bar-step 302.

To the right of the reference bar 301, there are the staggered bar-steps 302, 303, 304, 305, 306, 307, 308, 309, 310 with the horizontal offsets [X0, X1, X2, X3, X4, X5, X6, X7, X8], where Xn+1=Xn+y' (y' is the width of the solid bar-step plus a space of arbitrary value).

Each of these bar-steps 302, 303, 304, 305, 306, 307, 308, 309, 310 represents a 0.508 mm correction factor that can be applied to adjust the media top-of-form position. The correction factors are shown at the right of each stair bar-step 302, 303, 304, 305, 306, 307, 308, 309, 310 in FIG. 3.

In general, the staircase pattern may comprise a given number of printed bar-steps and a vertical reference bar.

The vertical reference bar may be placed at the edge of the pattern beginning at the top of the first bar-step and ending at the bottom of the last bar-step.

Figure 5:
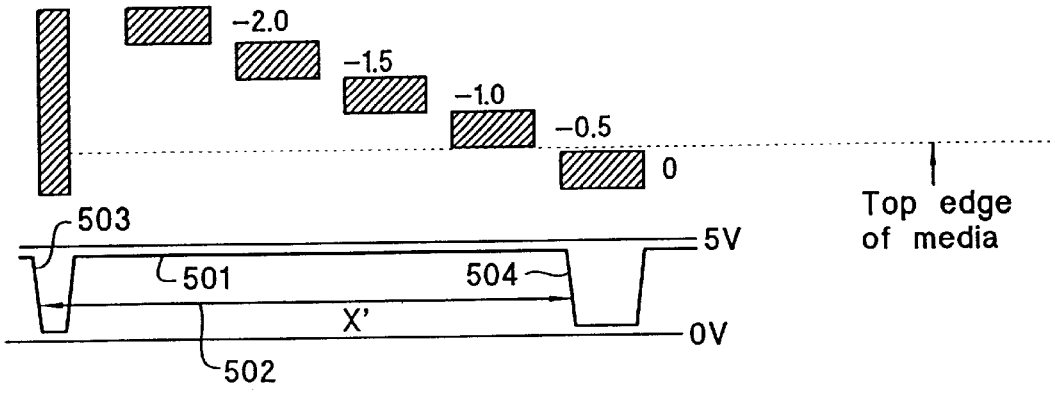
FIG. 5 shows a part of the staircase pattern according to the preferred embodiment and the result of a sensor scan when the medium enters the sensor's scan field.

An ideal top-of-form position is found when the top edge of the medium aligns with the top 320 of the "0" stair bar-step, i.e., with the top 320 of the fifth bar-step 306 (cf. FIG. 5).

If the top edge of the medium is aligned with the top 321 of the "0.5" stair bar-step, i.e., with the top 321 of the sixth bar-step 307, it indicates that the medium is underfed and that therefore addition of a positive correction factor, i.e., 0.508 mm to the top-of-form advance, is required.

Similarly, if the top edge of the medium is aligned with the top 322 of the "−0.5" stair bar-step, i.e., with the top 322 of the fourth bar-step 305, it indicates that the medium is overfed and therefore addition of a negative correction factor to, i.e., subtraction of 0.508 mm from the top-of-form advance, is required.

Figure 3:
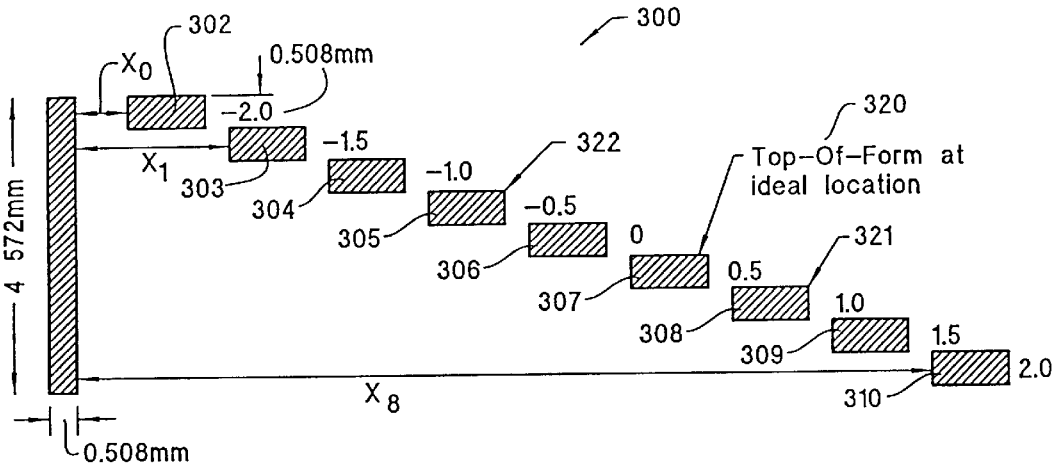
FIG. 3 shows the staircase pattern according to the preferred embodiment and its dimensions of the individual components in the print plot.
Figure 4:
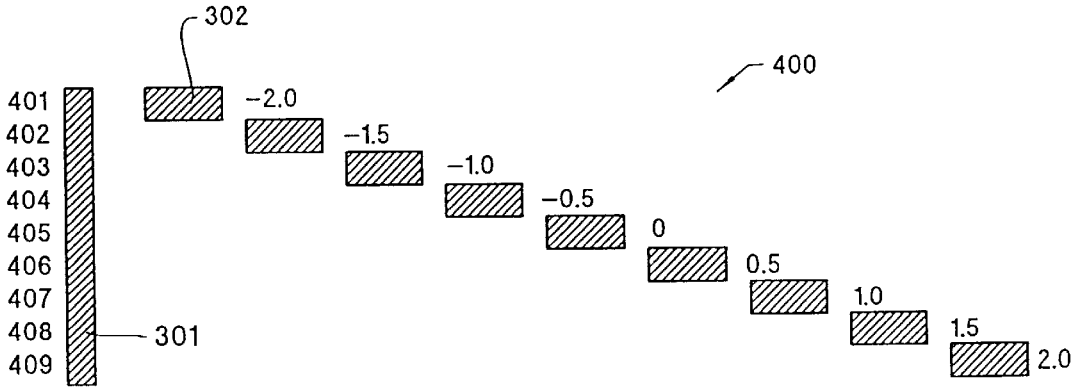
FIG. 4 shows the staircase pattern according to the preferred embodiment in a reference condition, e.g. an ideal situation.

At the current top-of-form y-axis position mentioned above, the detector of the sensor 203 will not register any reading because the medium is out of the field of view of the detector, which is a rectangle of dimensions 1 mm wide and 2 mm high. Moreover, in the preferred embodiment, the detector is placed approximately 4 mm behind the first nozzle of the print head of the printer. At this point, printing of the first sweep 401 of the staircase pattern 300, 400 as shown in FIG. 3 and FIG. 4 is begun.

The first sweep 401 of the carriage 201 is to print 0.508 mm height of the reference bar 301 and the first stair bar-step 302 of 0.508 mm height using 12 pen nozzles.

The second sweep 402 and the subsequent seven sweeps 403, 404, 405, 406, 407, 408, 409 will be made in the same manner as the first sweep 401.

The advance of the paper and the printing of the predefined pattern are controlled such that, in the case of an ideal top-of-form advance, the first sweep 401, the second sweep 402, the third sweep 403, and the fourth sweep 404 will be printed on the printer's platen and therefore will lay no ink on the paper. The fifth sweep 405 will be the first sweep which lays ink on the medium, followed by the next four sweeps (sixth sweep 406, seventh sweep 407, eighth sweep 408, ninth sweep 409) which will also lay ink on the paper.

After the predefined pattern is printed, in a fourth step (step 104), the sensor 203 begins a scan cycle, i.e. the print of the staircase pattern 300, 400 is detected from the paper. In the preferred embodiment, the media is reversed back to its original default top-of-form position after the entire predefined pattern has been printed. Subsequently, the sensor 203 begins the scan cycle.

The paper is advanced in steps of 12/600 inch and every advance is accompanied by a horizontal scan by the sensor 203.

In the case of an ideal top-of-form advance, as the sensor 203 sweeps across with a paper within its field of view, there will be some transition points in the data collected due to the difference in reflectance of the ink.

FIG. 5 shows the voltage reading 501 of the sensor scan when the paper first enters the sensor's field of view in the case of an ideal top-of-form advance.

From the data collected, the CPU 204 of the printer 200 determines a value X' which is the distance 502 between two falling edges 503, 504 of the reading 501 from the sensor's detector. The two falling edges 503 and 504 are corresponding to and generated by the left-side edge of the reference bar 301 and the left-side edge of the detected bar-step 302, . . . , or 310. In case of the ideal top-of-form advance, it is the "0" or fifth bar-step 306 whose left-side edge is detected.

Comparing the value X' with the known offsets [X0, X1, X2, X3, X4, X5, X6, X7, X8] for all the stair bar-steps 302 . . . 310, the bar-step detected by the sensor's detector is identified and, therefore, the correction factor assigned to the identified bar-step and to be added to the top-of-form position is determined.

In the case of an overfeed or an underfeed of the medium, the respective corrector factor can be determined based on the value X' calculated by the CPU 204 from the data detected by the sensor's detector and the known offset Xn.

Figure 6:
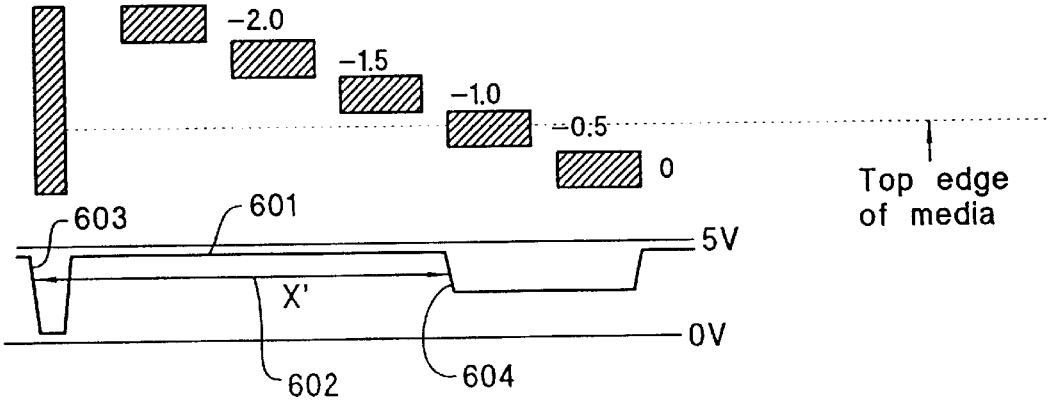
FIG. 6 shows a part of the staircase pattern according to the preferred embodiment and the result of a sensor scan when the medium enters the sensor's scan field in the case that the top edge of the medium is not aligned with the top of the stair step.

FIG. 6 illustrates a situation in which the top edge of the paper is not properly aligned with the top 320 of the fifth bar-step 306.

In the case shown in FIG. 6, the signals detected from the sensor's detector for the transition at the stair bar-step has degraded to less than half in magnitude of the ideal situation shown in FIG. 5. The stair bar-steps of the staircase pattern 300, 400 are staggered in the x-axis, i.e. in the horizontal direction and they do not overlap in the y-axis, i.e., in the vertical direction. Therefore, as the sensor 203 sweeps across the print, only parts of the stair bar-steps, namely the lower part of the "0.5" stair bar-step 305 and the upper part of the "0" stair bar-step 306 are detected by the sensor's detector. This results in the reduction in magnitude of the sensor signal detected by the sensor 203.

However, as long as the falling edges 603, 604 from the reading 601 can be determined, the value X', which is the distance 602 between the two falling edges 603, 604 of the reading 601 from the sensor's detector, can still be calculated.

Thus, the correction factor can still be made out from the value X'. So in the case shown in FIG. 6, a negative correction factor of 0.508 mm is added to the top-of-form advance, while there may be an error of approximately 0.2 mm from the ideal scenario, in which the top edge of the paper is perfectly aligned with the top 320 of the fifth bar-step 306.

Thus, in a fifth step 105, the value X' and/or the correction factor will be stored in the non-volatile storage device 205.

Furthermore, the correction factor is added to the top-of-form advance in a sixth step 106.

The drive roller 702 is moved according to the determined correction factor in order to bring the paper 703 from the original (current) top-of-form position into an optimized printing position. The correction factor is stored and subsequent sheets of paper are loaded into the carriage in said optimized printing position determined and adjusted on the basis of the original printing position and the determined correction factor. Thereby the top-of-form calibration process is completed.

It should be noted that, since the printing position (top-of-form position) is a relative position determined in relation to the printer's print head, according to the invention it is possible to carry out the adjustment of the printing position not only by adjusting the printing position itself, but also by adjusting the printer's print head relative to the original printing position.

A last step 107 describes the end of the program.

In another embodiment of the invention (not shown) the pattern has no reference bar and comprises only bar-steps with different colours. In this embodiment the bar-steps can be printed in an arrangement as in the previous embodiment illustrated in FIGS. 3 to 6 or directly above each other. In this case, for each colour used for the bar-steps in the pattern a corresponding correction factor is prestored in a memory, and the feature of the print to be determined during the calibration process is the colour information of the bar-step detected first from the print medium during the print detecting step. Based on the colour information of the detected bar-step the corresponding correction factor is then determined by looking-up for it in the memory. The calibration process is finished by adjusting the original printing position, i.e. the position in which the medium has originally been fed, according to the determined correction factor.

Similarly, the pattern may comprise bar-steps of different shapes, to each of which a correction factor is assigned and stored in a memory. In this case, the shape of the bar-step as the feature of the print is to be detected in order to determine the corresponding correction factor, on the basis of which the printing position is adjusted.

In the described embodiments of the invention the top edge of the print medium was utilized as said distinct positional characteristic of the print medium. In this case the feature of the print is determined on a portion of the print located along the top edge of the print medium. Thus, an easy way for using the method in the printer is provided as the print medium is fed into the printing position and the predetermined pattern may be generated as soon as the print medium has come with its top edge into the printing position without the need of many additional mechanical moves of the print medium.

However, according to another embodiment of the invention, any edge of the print medium may be utilized as the distinct positional characteristic of the print medium, e.g. not only the top edge, but also a bottom edge, as well as the side edge of the print medium. It is therefore within the scope of the present invention to calibrate the top-of-form position of the print medium by utilizing any edge of the print medium as distinct positional characteristic thereof. Similarly, it is within the scope of the present invention to calibrate the lateral position of the print medium by using the inventive calibration.

According to the invention the calibration is carried out on the basis of the determined feature, like the positional value of the print. In this case, the detection step may be performed by optical scanning, in which case the predefined pattern is preferably yellow. Advantages of using the colour yellow are that it is minimally reflective to many sensors and also least visible to the naked eye.

The means for detecting the printed pattern on the print medium may be a sensor attached to the carriage of the printer. The sensor may comprise a ray source directed onto the medium and a corresponding detector to detect reflected rays. The ray source may be a light emitting diode (LED) as well as a laser or any other source emitting rays which may be reflected by the print medium, thus enabling the corresponding detector to detect the reflected rays.

The described embodiments of the invention apply not only to the method but also to the device, the computer readable medium and the computer program.

What is claimed is:

1. A method for top-of-form calibration of a printer in which a print medium is fed into a printing position, comprising the following steps:

a) Printing a predefined pattern, thereby generating a print on the print medium, b) Detecting the print on the print medium, c) Determining from the detected print a feature of the print according to a distinct positional characteristic of the print medium, the feature of the print being characteristic for said printing position, d) Determining a correction factor from the determined feature of the print, and e) Processing the top-of-form calibration of the printer on the basis of the determined correction factor.

2. A method according to claim 1, wherein said correction factor is used for correcting said printing position and the step of processing the top-of-form calibration is accomplished by adjusting said printing position.

3. A method according to claim 1, wherein said feature of the print is the colour of the print.

4. A method according to claim 1, wherein said feature of the print is a positional value of the print, and the step of determining the correction factor comprises the sub-steps of d1) Comparing said positional value with a predetermined reference positional value, d2) Determining, if present, a deviation of said positional value from the predetermined reference positional value, and d3) Determining said correction factor from the determined deviation.

5. A method according to claim 3, wherein a) the detection step is performed by optical scanning, and b) the predefined pattern is yellow.

6. A method according to claim 1, wherein the distinct positional characteristic is an edge of the print medium.

7. A method according to claim 6, wherein the print on the print medium is a part of the predefined pattern and is limited by said edge, and said feature of the print is determined on a portion of the print located along said edge.

8. A method according to claim 7, wherein the predefined pattern is a staircase pattern.

9. A method according to claim 8, wherein the staircase pattern comprises:

a) a given number of printed bar-steps, and b) a vertical reference bar.

10. A computer readable medium, having a program recorded thereon, where the program makes the computer execute a procedure comprising the following steps for top-of-form calibration of a printer in which a print medium is fed into a printing position:

a) Printing a predefined pattern, thereby generating a print on the print medium, b) Detecting the print on the print medium, c) Determining from the detected print a feature of the print according to a distinct positional characteristic of the print medium, the feature of the print being characteristic for said printing position, d) Determining a correction factor from the determined feature of the print, and e) Processing the top-of-form calibration of the printer on the basis of the determined correction factor.

11. A computer program element which makes the computer execute a procedure comprising the following steps for top-of-form calibration of a printer in which a print medium is fed into a printing position:

a) Printing a predefined pattern, thereby generating a print on the print medium, b) Detecting the print on the print medium, c) Determining from the detected print a feature of the print according to a distinct positional characteristic of the print medium, the feature of the print being characteristic for said printing position, d) Determining a correction factor from the determined feature of the print, and e) Processing the top-of-form calibration of the printer on the basis of the determined correction factor.

12. A method for calibration of a printer in which a print medium is fed into a printing position, the printer having a platen for supporting the print medium during printing, comprising the following steps:

a) printing a predefined pattern, including generating a first portion of a print on the platen, and generating a second portion of the print on the print medium, b) detecting the second portion of the print on the print medium, c) determining from the detected second portion a feature according to a distinct positional characteristic of the print medium, d) determining a correction factor from the determined feature of the print, and e) processing the calibration of the printer on the basis of the determined correction factor.

13. A method for calibration of a printer in which a print medium is fed into a printing position, the printer having a platen for supporting the print medium during printing, comprising the following steps:

a) printing a plurality of horizontal bars in a staircase pattern by placing each horizontal bar immediately below a preceding horizontal bar vertically but horizontally offset by a fixed internal distance, thereby generating a first portion of a print on the platen and a second portion of the print on the print medium, b) detecting the second portion of the print on the print medium, c) determining from the detected second portion a feature according to a distinct positional characteristic of the print medium, d) determining a correction factor from the determined feature, and e) processing the calibration of the printer on the basis of the determined correction factor.

14. The method of claim 13, further comprising:

a) printing a vertically extended reference bar on the print medium, b) detecting the vertically extended reference bar, and c) determining said feature from both the detected reference bar and the second portion.

* * * * *